US007588345B1

(12) United States Patent
Davis et al.

(10) Patent No.: US 7,588,345 B1
(45) Date of Patent: Sep. 15, 2009

(54) LIGHTING SYSTEM

(75) Inventors: Scott A. Davis, Providence, RI (US); Mikael Robbins, Taunton, MA (US)

(73) Assignee: Arch Lighting Group Inc., Taunton, MA (US)

( * ) Notice: Subject to any disclaimer, the term of this patent is extended or adjusted under 35 U.S.C. 154(b) by 173 days.

(21) Appl. No.: 11/325,137

(22) Filed: Jan. 4, 2006

Related U.S. Application Data

(60) Provisional application No. 60/641,703, filed on Jan. 6, 2005.

(51) Int. Cl.
*F21S 4/00* (2006.01)

(52) U.S. Cl. ..... 362/223; 362/225; 362/245; 362/349

(58) Field of Classification Search ..... 362/223, 362/224, 33, 97, 225, 241, 244, 245, 247, 362/248, 308–310, 326, 327, 355, 328, 339, 362/346, 347, 348, 349
See application file for complete search history.

(56) References Cited

U.S. PATENT DOCUMENTS 1,941,079 A * 12/1933 Exelmans ..... 362/224
2,623,160 A * 12/1952 McPhail ..... 362/223
3,113,728 A * 12/1963 Boyd ..... 52/28
3,210,875 A * 10/1965 Schwenkler ..... 40/589
3,599,596 A * 8/1971 Remus et al. ..... 116/334
3,681,591 A * 8/1972 Loch ..... 362/217
4,088,881 A * 5/1978 Neer et al. ..... 362/223
4,204,274 A * 5/1980 Luderitz ..... 362/239
4,625,267 A * 11/1986 Mikalonis ..... 362/150
4,667,275 A * 5/1987 Herst et al. ..... 362/223
4,891,737 A * 1/1990 Szymanek ..... 362/223
5,038,254 A * 8/1991 Fabbri et al. ..... 362/33
5,146,393 A * 9/1992 Crane ..... 362/260
5,160,193 A * 11/1992 Fabbri et al. ..... 362/33
5,530,628 A * 6/1996 Ngai ..... 362/33
5,537,302 A * 7/1996 Hillstrom et al. ..... 362/246
5,558,425 A * 9/1996 Pons et al. ..... 362/490
5,716,123 A * 2/1998 Lamming ..... 362/222
5,967,648 A 10/1999 Barnes, II et al.
5,988,829 A * 11/1999 Holder ..... 362/217
6,062,704 A * 5/2000 Holder ..... 362/223
6,709,131 B1 * 3/2004 Herst et al. ..... 362/223
7,068,332 B2 * 6/2006 Liu et al. ..... 349/64
7,093,955 B2 * 8/2006 Sejkora et al. ..... 362/223

* cited by examiner

*Primary Examiner*—Hargobind S Sawhney
(74) *Attorney, Agent, or Firm*—Salter & Michaelson

(57) ABSTRACT

A lumenaire including a light fixture housing for supporting a lamp and a reflector disposed over the lamp. A diffuser is arranged under the lamp and has a lower arch-shaped portion for supporting a liner with a predetermined pattern for both reflecting and transmitting incident light from the lamp. The diffuser also includes upper end portions comprised of a material for refracting incident light from the lamp.

37 Claims, 9 Drawing Sheets

LIGHTING SYSTEM

RELATED APPLICATIONS

The present application claims priority to U.S. Provisional Application Ser. No. 60/641,703 filed on Jan. 6, 2005.

TECHNICAL FIELD

The present invention relates in general to an improved lighting system, particularly one that is characterized by high-efficiency lumenaire performance with minimized glare and brightness. The present invention also pertains to an improved lighting fixture that employs a novel lamp diffuser and reflector arrangement.

BACKGROUND OF THE INVENTION

There is a need in the field to provide lighting fixtures or systems that have enhanced efficiency and that yet are characterized by a minimized glare and brightness. In the past various techniques have been devised to improve the efficiency and glare characteristics of lumenaires. For example, a recent lighting fixture is disclosed in U.S. Pat. No. 5,967,648 in which, in the background discussion, various past techniques are described to enhance the efficiency and uniformity of the output light. The lumenaire disclosed in this patent describes the use of a sheet of polymeric light control film which is comprised of a thin sheet of clear polymeric material with an embedded layer of metallic foil that is perforated to allow a measured amount of light to pass therethrough. Even with this improvement existing lighting apparatus still has certain drawbacks associated therewith including, inter alia, excessive glare, excessive brightness, direct viewing of the lamp from certain angles, non-uniformity of the light pattern and degraded efficiency.

Accordingly, it an object of the present invention to provide an improved lumenaire that overcomes the limitations of known arrangements.

Another object of the present invention is to provide a lumenaire that is characterized by minimizing glare and brightness from the fixture, all while enhancing the efficiency of the lumenaire.

SUMMARY OF THE INVENTION

The foregoing and other objects of the invention are achieved by providing a lumenaire that is comprised of a lighting fixture; a lamp supported in the lighting fixture; and a diffuser disposed spaced from and at least partially about the lamp. The diffuser includes a middle portion under the lamp comprised of a material with a predetermined pattern for both reflecting and transmitting incident light from the lamp and end portions contiguous with the middle portion disposed toward the sides of the lamp and comprised of a material for refracting incident light from the lamp.

In accordance with other aspects of the present invention the middle portion may be arc-shaped and includes a translucent plastic base, for supporting inside thereof, a partially reflective liner that carries the predetermined pattern; the liner may include in the pattern, areas that are translucent to permit light to be transmitted and areas that are metallic to permit light to be reflected to a reflector disposed over the lamp; the end portions may be formed by respective extensions of the translucent plastic base, said extensions terminating at a position above a horizontal centerline of the lamp so as to obscure the image of the lamp from all viewing angles therebelow; a reflector is supported in the lighting fixture over the lamp with the lamp disposed asymmetrically relative to the reflector closer to one side of the fixture than another side of the fixture and with the end portions positioned to enable incident light from the lamp to be reflected from the reflector; the reflector may comprise a straight walled section adjacent the one side of the fixture and an arcuate shaped section adjacent the another side of the fixture; the end portions may have a ribbed construction and the liner terminates short of the extensions and liner retention tab may be included between the middle portion and each end portion for holding the liner in place.

In accordance with another version of the invention the lumenaire comprises a lighting fixture; a lamp supported in the lighting fixture; a diffuser disposed spaced from and at least partially below and about the lamp; and a reflector supported in the lighting fixture over the lamp with the lamp disposed asymmetrically relative to the reflector closer to one side of the fixture than another side of the fixture and the reflector includes a straight walled section adjacent the one side of the fixture and an arcuate shaped section adjacent the another side of the fixture.

In accordance with still other aspects of the invention the diffuser may include a middle portion under the lamp comprised of a material with a predetermined pattern for both reflecting and transmitting incident light from the lamp and end portions contiguous with the middle portion disposed toward the sides of the lamp and comprised of a material for refracting incident light from the lamp; the end portions may be positioned to enable incident light from the lamp to be reflected from the reflector; the reflector arcuate shaped section may include contiguous first and second arcuate shaped sections intercoupled by a step section; the first arcuate shaped section may step up from the second arcuate shaped section and the first arcuate shaped section may be more remote from the one side of the fixture than the second arcuate shaped section; the middle portion may be arc-shaped and includes a translucent plastic base, for supporting inside thereof, a partially reflective liner that carries the predetermined pattern and wherein the liner includes in the pattern, areas that are translucent to permit light to be transmitted and areas that are metallic to permit light to be reflected to the reflector disposed over the lamp.

In accordance with a further embodiment of the present invention there is provided a lumenaire system that is comprised of a plurality of separate lighting fixtures, each lighting fixture for support from a ceiling or the like and collectively directed to illuminate a predetermined area therebelow, each lighting fixture including at least a lamp, a reflector disposed over the lamp and a diffuser disposed under the lamp, said plurality of fixtures including at least one symmetric fixture in which the lamp is arranged symmetrically centered relative to the reflector and at least one asymmetric fixture in which the lamp is arranged asymmetrically relative to the reflector closer to one side of the fixture than another side of the fixture.

In accordance with other aspects of the present invention at least a pair of symmetric fixtures and at least a pair of asymmetric fixtures may be arranged in an array with the asymmetric fixtures disposed outside of the symmetric fixtures in the array; the asymmetric fixtures may be arranged so that the one side of the asymmetric fixture is disposed on the outside of the array; switch means is provided for controlling the operation of the fixtures and the switch means has at least two modes including a first mode in which only the pair of asymmetric fixtures are energized and a second mode in which both pairs of fixtures are energized.

In accordance with still another embodiment of the invention the lighting apparatus is adapted for support from a ceiling or the like and comprises: a lighting housing; a lamp supported in the lighting housing; a diffuser disposed spaced from and at least partially about the lamp and including an arc-shaped portion disposed under the lamp for both reflecting and transmitting incident light from the lamp and end ribbed portions contiguous with the arc-shaped portion disposed over the horizontal centerline of the lamp for refracting incident light from the lamp and a reflector supported in the lighting housing over the lamp. The lamp may be disposed asymmetrically relative to the reflector closer to one side of the lighting housing than another side of the lighting housing. The reflector may include a straight walled section adjacent the one side of the lighting housing and an arcuate shaped section adjacent the another side of the lighting housing.

DESCRIPTION OF THE DRAWINGS

Numerous other objects, features and advantages of the present invention should now become apparent upon a reading of the following detailed description taken in conjunction with the accompanying drawings, in which.

DETAILED DESCRIPTION

Figure 9:
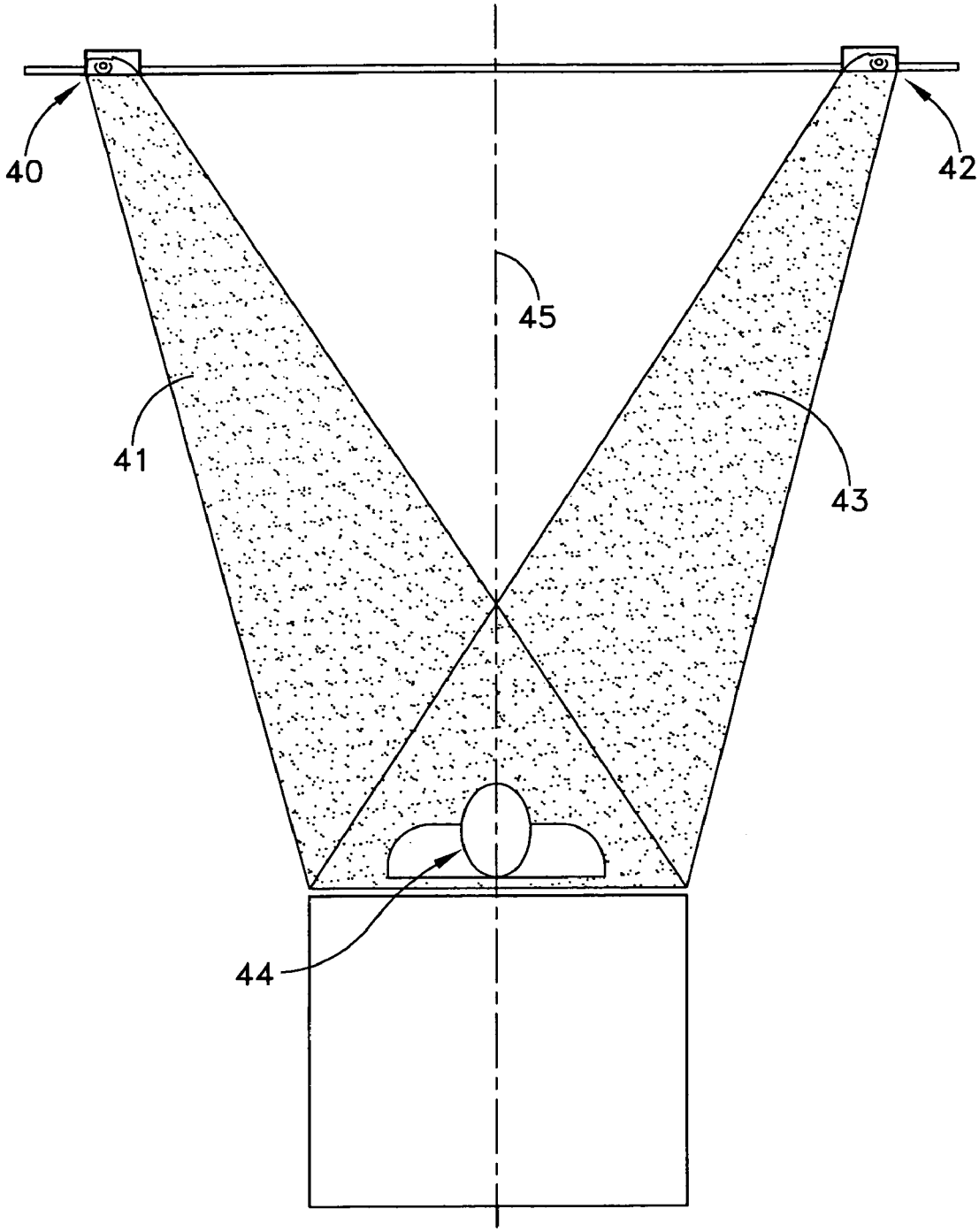
FIG. 9 is a schematic diagram illustrating multiple asymmetric fixtures and the lighting pattern to a subject.
Figure 10:
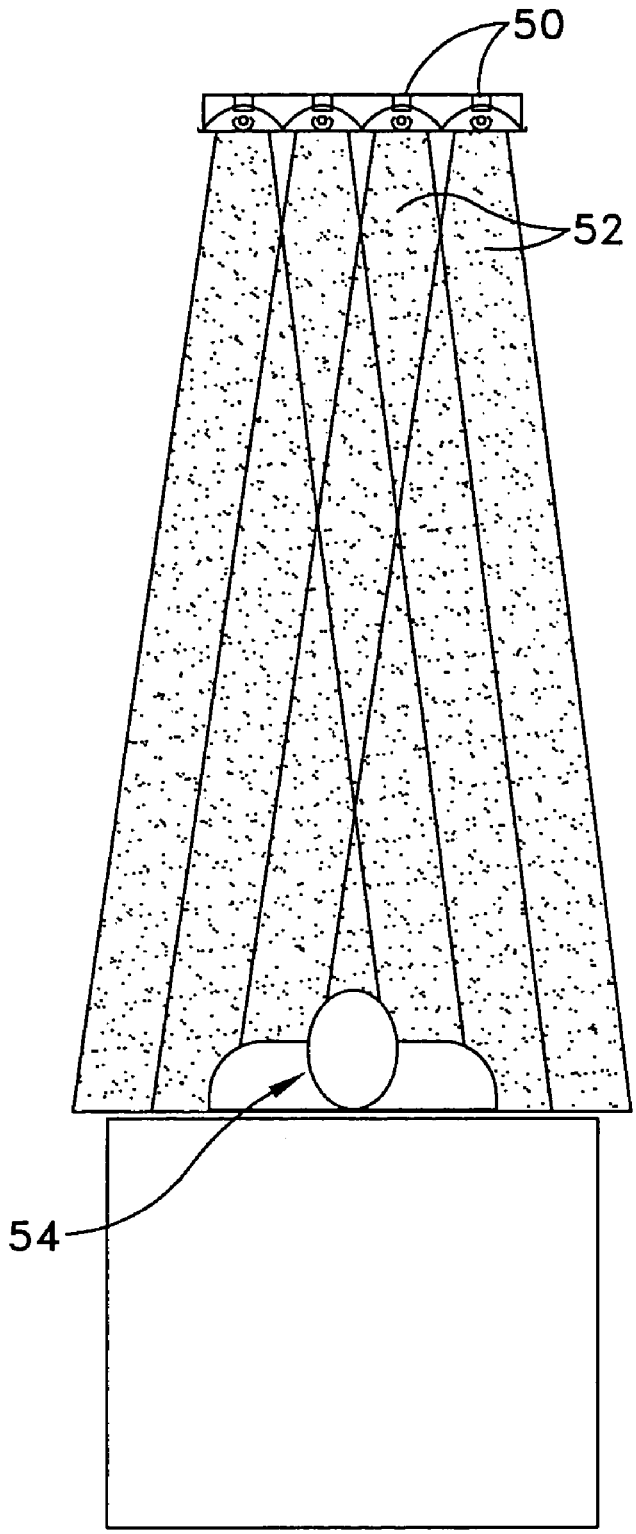
FIG. 10 is a schematic diagram illustrating a plurality of symmetric distribution fixtures relative to a subject.
Figure 11:
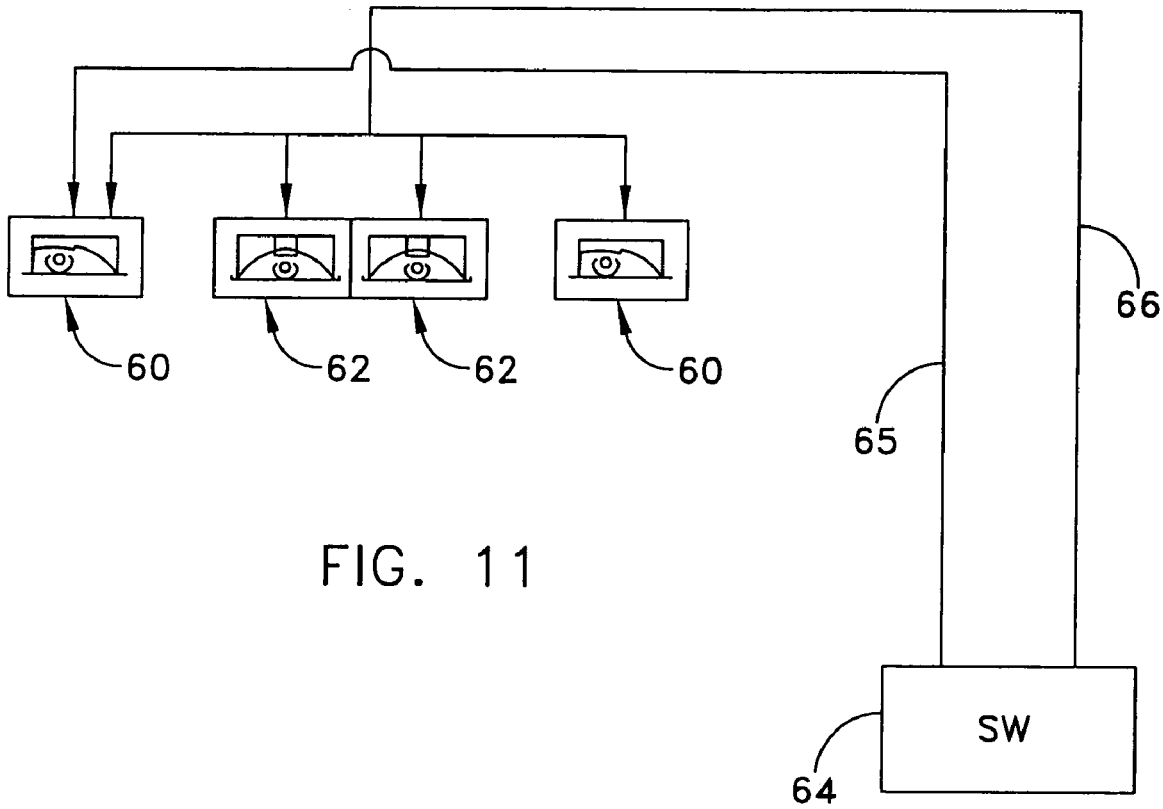
FIG. 11 is a schematic diagram illustrating a switching arrangement that may be used with a particular lighting array in accordance with the present invention.
Figure 12:
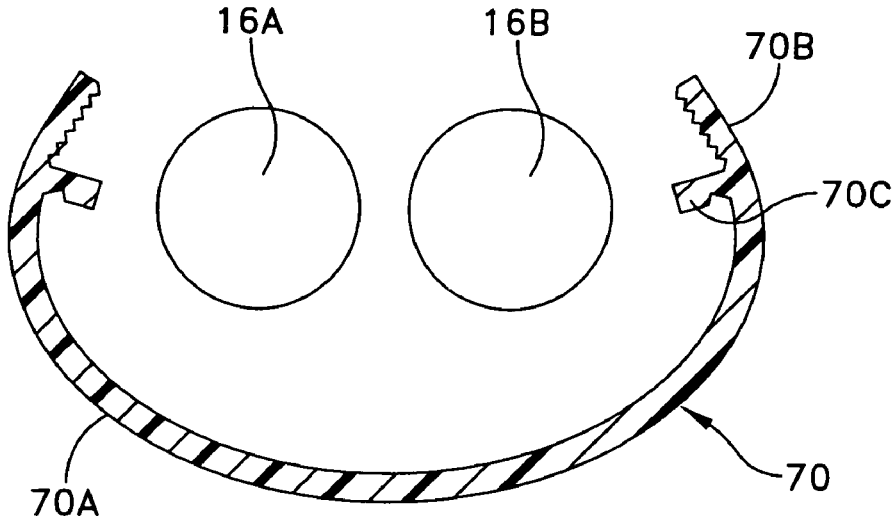
FIG. 12 is a view similar to that shown in FIG. 4 but for an arrangement in which a pair of lamps are associated with a single diffuser.

Reference is now made to both symmetric and asymmetric embodiments of the present invention as illustrated in FIGS. 1-8. FIGS. 9-11 illustrate particular arrays of lumenaires that may be arranged in accordance with the present invention. FIG. 12 describes an alternate embodiment using a pair of lamps with a single diffuser. This lamp apparatus in the main embodiment employs an extruded polymeric lamp diffuser with a polymeric light control film liner for use in lighting fixtures. The unique characteristics of the lumenaire of the present invention allow for high-efficiency lumenaire performance with minimized glare and brightness from all viewing angles. This makes the apparatus particularly appropriate for use as, for example, a patient exam light. This would thus find use in hospitals, dental offices, physician offices, etc. However, the lumenaire of the present invention also is suitable to applications such as video-teleconferencing and other general lighting applications where a direct view of the lighting fixture from abnormal viewing angles (typically looking straight up at, or otherwise into the fixture) is likely.

Figure 3:
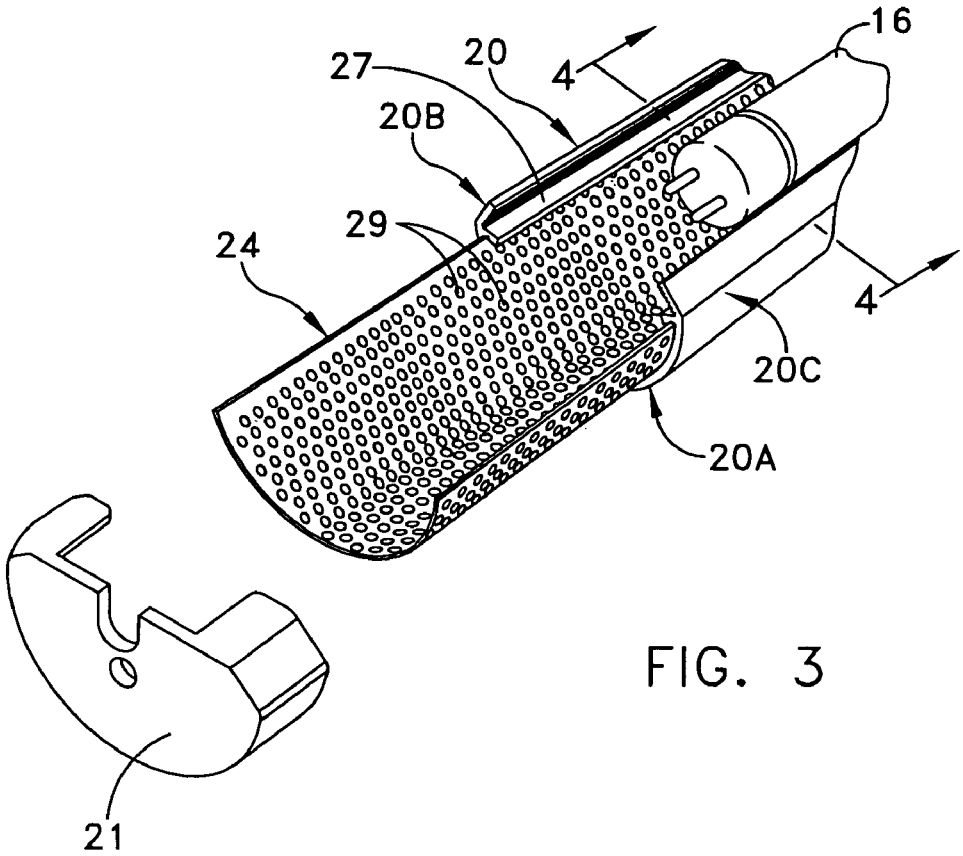
FIG. 3 is a partial perspective view of the diffuser alone and partially exploded to show further details.
Figure 4:
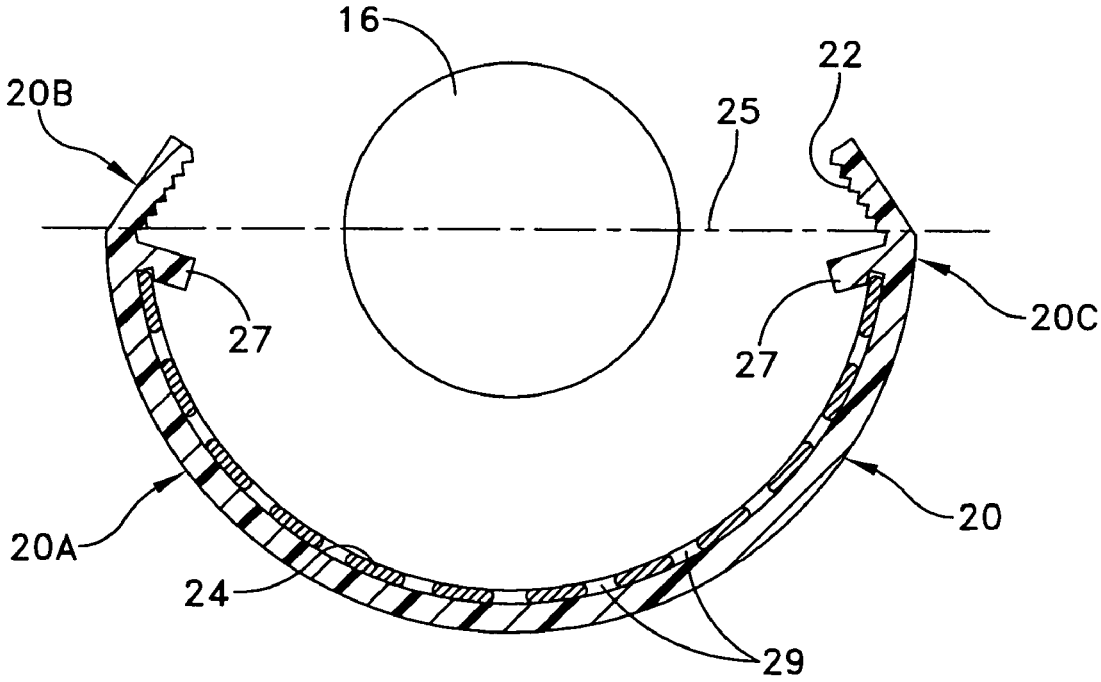
FIG. 4 is a cross-sectional view through the diffuser such as along line 4-4 in FIG. 3 and showing the placement of the diffuser relative to the lamp.
Figure 5:
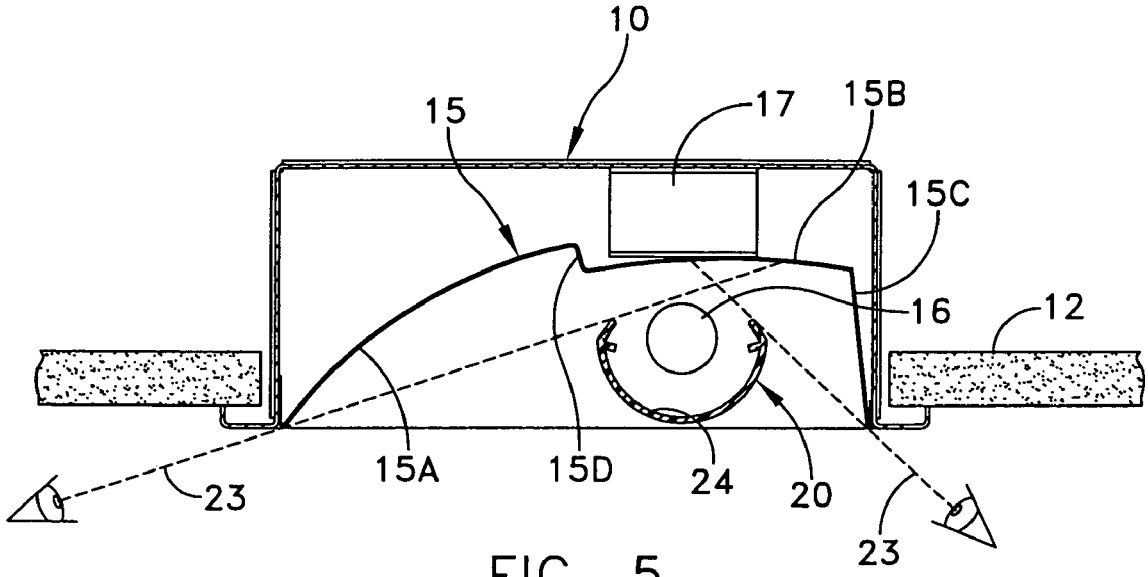
FIG. 5 is a cross-sectional view illustrating one embodiment of the present invention, an asymmetric distribution fixture.

Reference is now made to the asymmetric distribution fixture illustrated in FIGS. 1-5. The lumenaire is embodied as a fixture that is comprised of a housing 10. The housing may be considered as of conventional design and is typically constructed of fabricated steel, extruded aluminum or other suitable materials or a combination of materials. The housing 10 may be either surface mounted or recessed into a ceiling, wall or other surface support surface. Refer to FIG. 5 for a typical arrangement in which the fixture is recessed into the ceiling structure 12.

A reflector 15 is shown supported in the housing 10 and is adapted to direct illumination to specific controlled angles while cutting off illumination to other angles. Although various configurations of reflectors can be used with one aspect of the present invention, the asymmetric reflector 15, such as shown in FIG. 5, has been particularly advantageous in accomplishing the desired lighting patterns. The specific construction of reflector 15 is discussed below. A fluorescent lamp 16 is positioned below the reflector 15. The lamp 16 may be considered as of conventional type and can be provided in different diameters. A conventional ballast 17 may be supported in the housing 10 as schematically illustrated in FIG. 5.

FIGS. 1-5 also illustrate the polymeric lamp diffuser 20 that supports the polymeric light control film liner 24. The diffuser is positioned so as to essentially envelop the lamp 16 and obscure it from all practical viewing angles. FIG. 5 shows the viewing or sight angles at 23. It is noted that these angle lines indicate that the diffuser preferably blocks any viewing from below. Neither of the lines 23 intersect any part of the lamp 16. It is primarily the top ends of the diffuser that block the lamp.

In accordance with the invention there is provided a lumenaire including a lamp 16 supported in a lighting fixture and a diffuser 20 disposed spaced from and at least partially about the lamp 16. The diffuser 20 may be considered as including a middle or lower portion 20A under the lamp comprised of a material with a predetermined pattern for both reflecting and transmitting incident light from the lamp and end or upper portions 20B contiguous with the middle portion disposed toward the sides of the lamp and comprised of a material for refracting incident light from the lamp 16.

The diffuser 20 may be considered as provided in three sections, the lower portion 20A, upper portion 20B and an intermediate retaining portion 20C. The entire diffuser can be constructed of the same material or each section can be constructed of a different material to provide particular characteristics. The diffuser is preferably constructed by an extrusion process. In the preferred embodiment the entire diffuser is constructed of a clear polymeric plastic material. The lower portion 20A of the diffuser is preferably smooth and semi-cylindrical in shape as shown in FIG. 4. The upper portion 20B of the diffuser on both sides has a series of fine v-shaped ribs 22 constructed and arranged to obscure the image of the lamp 16 from all viewing angles 23 while allowing a significant portion of the lamp's output to pass through the diffuser upper portion 20B. As is noted from FIG. 4, the horizontal centerline 25 of the lamp 16 passes about through the area where the portions 20A and 20B interconnect. Also at that area is the intermediate portion 20C in the form of elongated retention tabs or ridges 27 that are adapted to hold the liner 24 in place. These tabs 27 extend the length of the diffuser.

The interior surface of the lower portion 20A of the diffuser 20 contains an inserted sheet of polymeric light control film 24 which is comprised of a thin sheet of clear polymeric material with an embedded layer of metallic foil that is perforated to allow a measured amount of light to pass through. The perforations are preferably in a predetermined pattern such as a series of holes disposed in a symmetric array. The holes are shown at 29 in FIG. 4. The foil as used in this application may be white, colored or otherwise decorated on the outer surface (away from the lamp) as a decorative feature. In order to maximize fixture efficiency, the inner surface of the foil has a highly reflective metallic surface to direct the portion of light from the lamp that does not pass through the perforated holes back towards the reflector 15. The liner material 24 may be slid or snapped into position, thus allowing field replacement and/or the substitution of liners with varying perforation patterns. The tabs 27 hold the liner 24 in place. Refer to U.S. Pat. No. 5,967,648 for a description of various forms of polymeric materials used in lumenaires. U.S. Pat. No. 5,967,648 is hereby incorporated by reference in its entirety.

Thus, the diffuser in accordance with a preferred embodiment described herein includes a lower portion 20A that is a clear smooth arc-shaped portion of the diffuser. This portion 20A receives and is instrumental in shaping the liner 24. The portion 20A controls the output generated from the lower portion of the lamp 16. The upper portion 20B of the diffuser 20 is a clear ribbed structure that extends the length of the diffuser and is positioned symmetrically about the center line 25 of the tube 16. These ribbed portions, as shown in FIG. 4 are angled toward each other to obscure the view of the bare lamp 16 from normal viewing angles while directing and refracting the output from the upper half of the lamp toward the reflector 15. The liner retention tabs 27 hold the liner 24 snugly in position while allowing interchangeability or replacement. Liner 24 is slid or snapped into position and is removable and replaceable.

Figure 1:
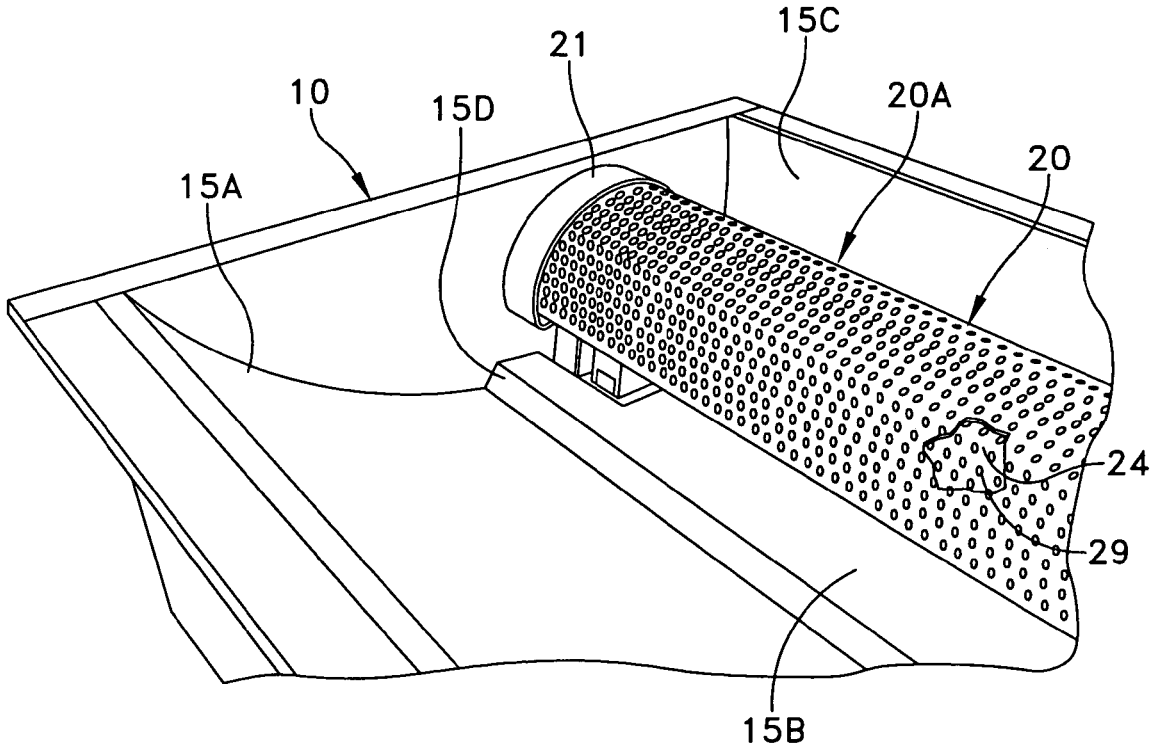
FIG. 1 is a perspective view at the end of a lighting fixture constructed in accordance with the present invention with the diffuser clipped in place.
Figure 2:
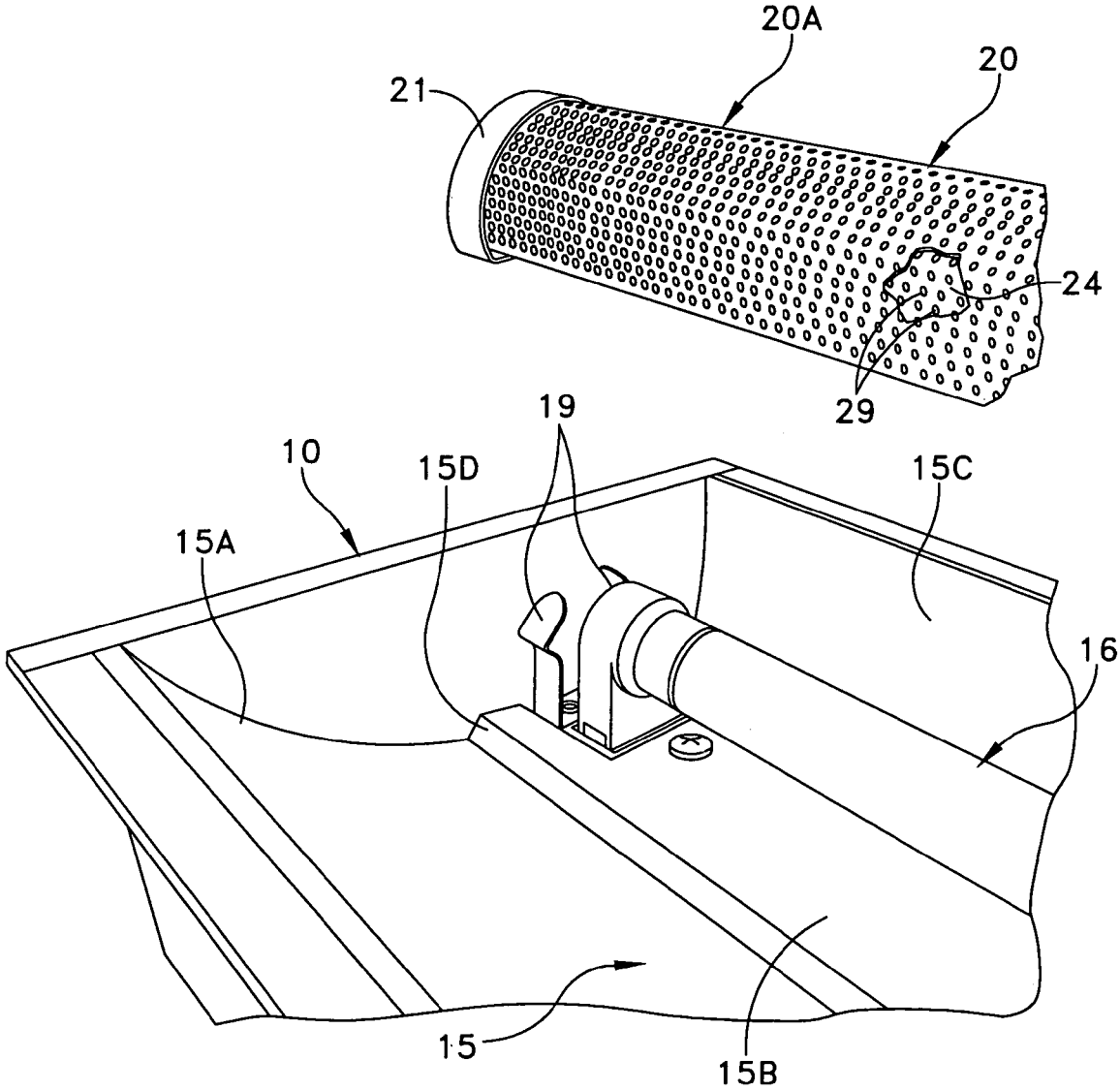
FIG. 2 is a perspective view at the end of the fixture similar to that illustrated in FIG. 1 but with the diffuser exploded away from the lamp.

In FIGS. 1-3 there are illustrated further details of the support for the diffuser in the fixture. For this purpose there are provided a pair of end caps 21, one at each end of the diffuser 20. These end caps 19 also help to retain the liner 24 in place. A pair of clips 19 is supported adjacent to the conventional end supports for the lamp 16 as shown in FIG. 2. The end caps 21 are adapted to releasably engage with the clips 19 in order to support the entire diffuser 20 in the fixture, as shown in FIG. 1.

Figure 7:
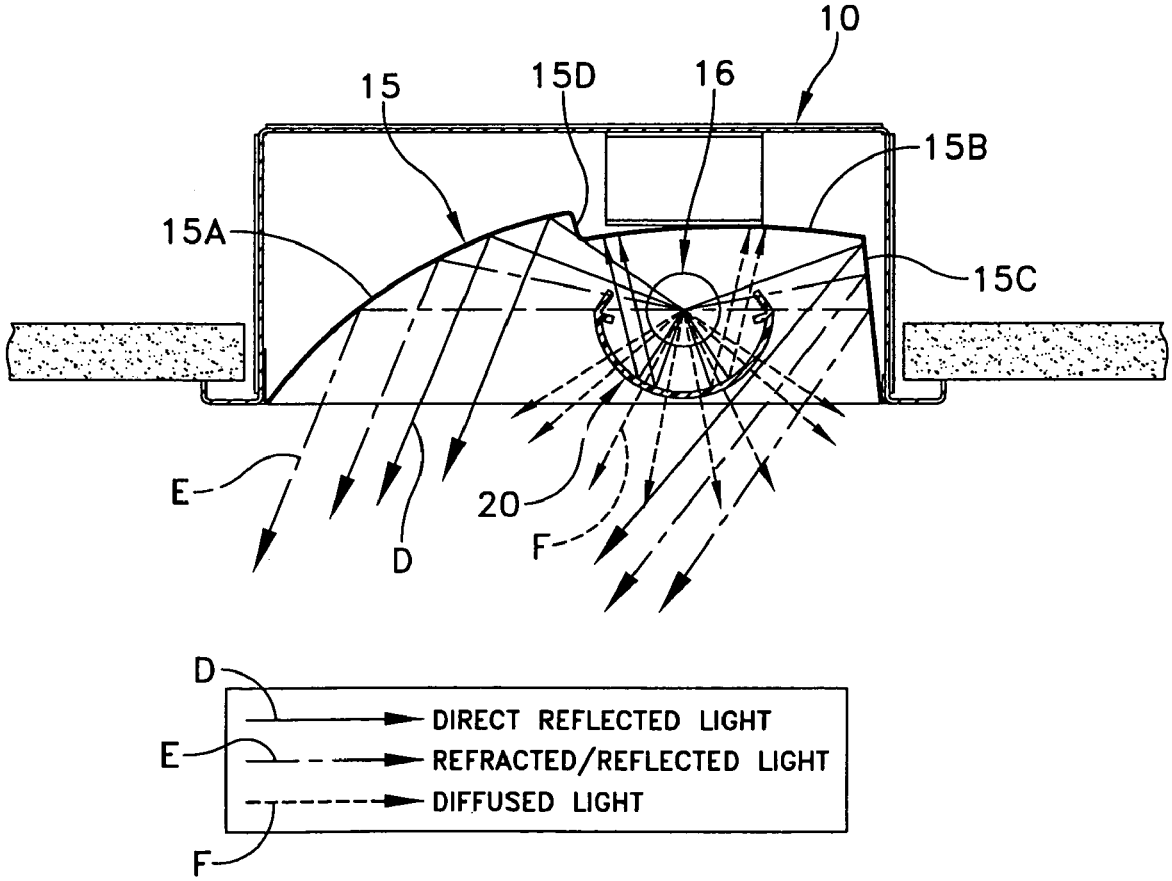
FIG. 7 is a schematic diagram of the first embodiment with an asymmetric distribution fixture and illustrating the light rays.

Reference is now made to FIG. 5 for an illustration of an asymmetric distribution fixture in which the lamp 16 is disposed off-center of the housing (to the right of center) and the reflector is likewise non-symmetric. The reflector preferably is constructed in three sections including a first arcuate portion 15A, a second arcuate portion 15B and a straight end portion 15C. The step 15D interconnects the portions 15A and 15B. The arcuate portion 15A preferably has a smaller radius of curvature than the arcuate portion 15B. The reflector portion 15C is preferably adjacent to the side of the housing that the lamp is closer to. Refer to FIG. 7 for further descriptions of the reflector surfaces as relates to the light patterns from the lamp.

Figure 6:
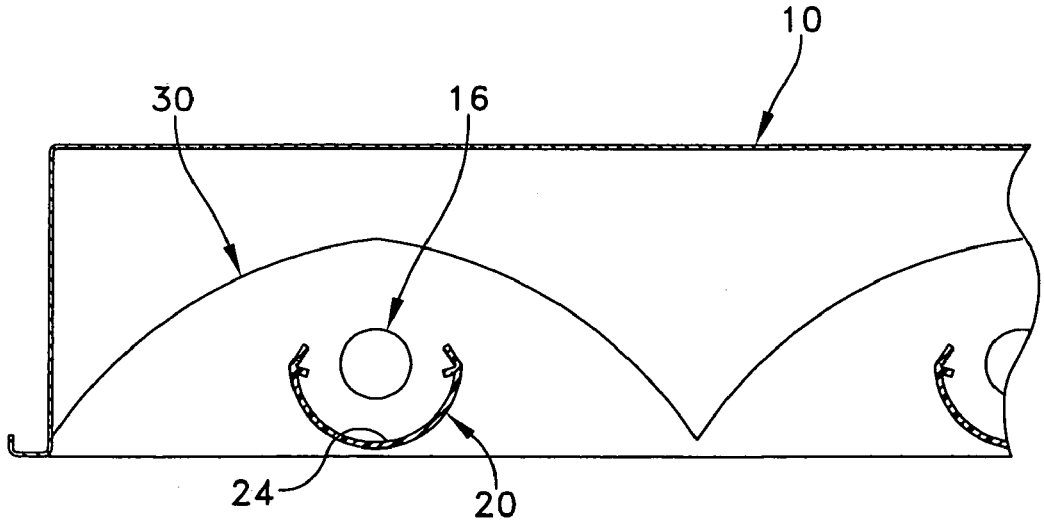
FIG. 6 is a cross-sectional view illustrating a second embodiment of the present invention, a symmetric distribution figure with multiple lamps.

Reference is now made to FIG. 6 for an illustration of a symmetric distribution fixture in which the lamp 16 is disposed centered in the housing in a symmetric distribution fixture. In this embodiment the lamp and diffuser may be identical to that previously described. The reflector 30 may be one continuous arcuate or parabolic surface or can be made from a pair of surfaces. The lamp 16 is disposed symmetric relative to the reflector 30. FIG. 6 also shows how multiple lumenaires can be formed in an array. Refer also to FIG. 10 for an illustration of a symmetric array of four lamps.

Figure 8:
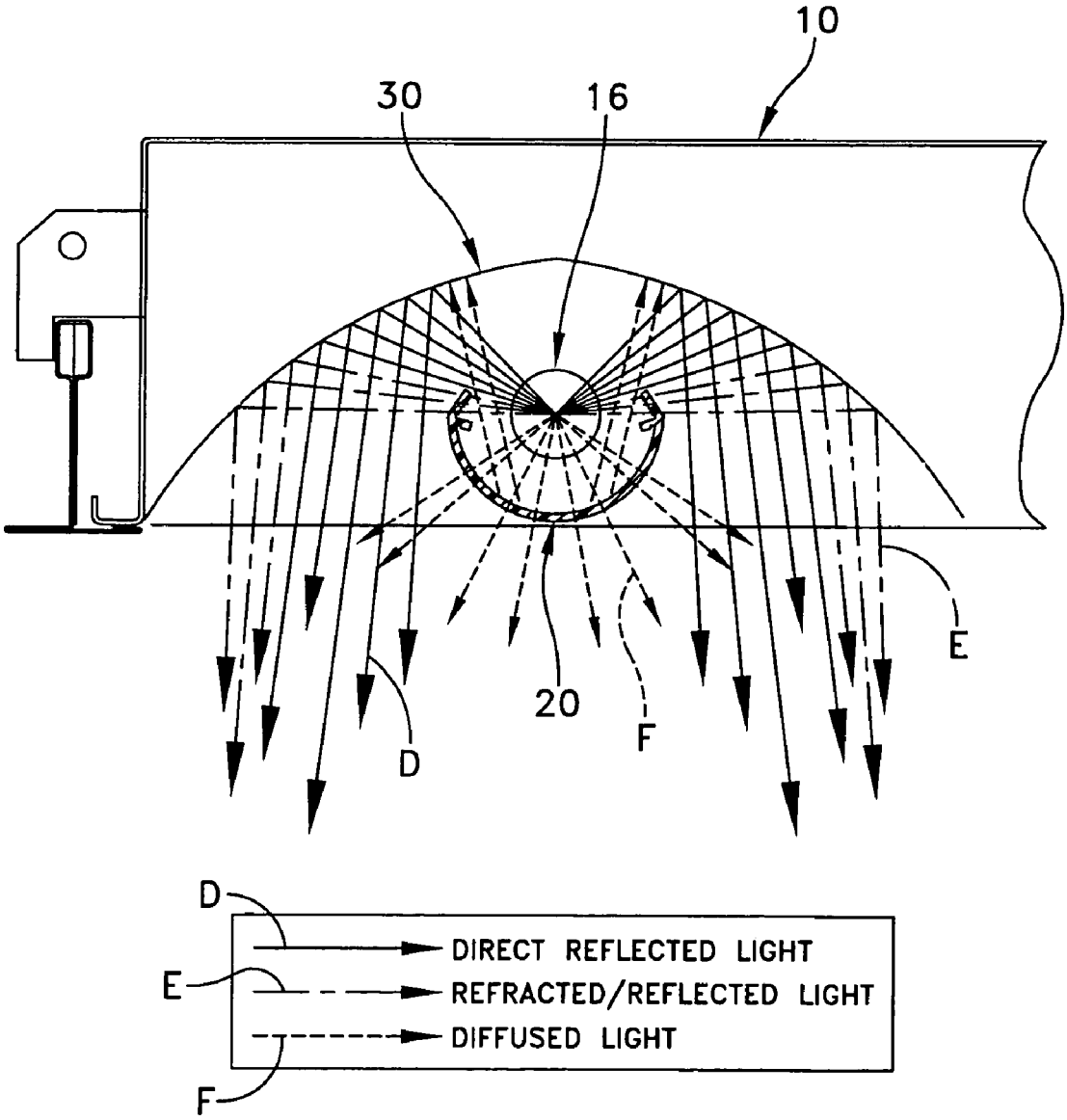
FIG. 8 is a schematic diagram of the second embodiment with a symmetric distribution fixture and illustrating the light rays.

Reference is now made to FIGS. 7 and 8 for further descriptions of the light patterns emanating from the respective asymmetric and symmetric fixtures. In both FIGS. 7 and 8 the fixtures are of the recessed type, however, the principles of the present invention apply equally to non-recessed fixtures and regardless of how or where they are mounted. FIG. 7 illustrates a symmetric light distribution fixture design that may utilize a single lamp 16 per fixture. The lamp and diffuser are oriented so that the reflector portions on either side of the lamp and diffuser can be positioned to direct virtually all reflected light towards a single target point which is above nadir.

FIG. 7 also shows, by arrows, the different light beams and the direct and indirect lighting components thereof. This includes direct reflected light D, refracted/reflected light E and diffused light F. Light from the lower part of the lamp directed at the lower diffuser portion 20A is shown diffused through the diffuser portion where the perforation are and also shows some light reflected toward the reflector portion 15B. Light from an upper part of the lamp is shown as direct reflected light that is reflected from the reflector at least portions 15A and 15C. FIG. 7 also shows refracted light through the upper portion 20B of the diffuser 20. To provide the preferred light direction toward a single target point the reflector has a substantially flat portion 15C close to the lamp 16. In addition, the reflector is preferably stepped so that the reflector portion 15A directs the light toward the single target point. The single target point is where the reflected rays converge, usually several feet from the fixture.

FIG. 8 shows a symmetric light distribution fixture that may utilize multiple lamps within a single fixture. In FIG. 8 only one of the lamp/reflector combinations is illustrated. The number of lamps 16 utilized determines the total lumen output of the fixture. Regardless of the number of lamps used, each lamp and diffuser is positioned within a reflector 30 that is specially designed to symmetrically direct illumination towards nadir with each lamp cell having a beam spread of approximately 20°. The beams on either side of the lamp are preferably formed to cross one another before hitting the target surface so as to minimize shadowing and to contain the illumination to the limits of the bed or other surface below. This design could also be used for wall washing, sign illumination or other similar purposes.

FIG. 8 also shows, by arrows, the different light beams and the direct and indirect lighting components thereof. This includes direct reflected light D, refracted/reflected light E and diffused light F. Light from the lower part of the lamp directed at the lower diffuser portion 20A is shown diffused through the diffuser portion where the perforation are and also shows some light reflected toward the reflector 30. Light from an upper part of the lamp is shown as direct reflected light that is reflected from the reflector 30. FIG. 8 also shows refracted light through the upper portion 20B of the diffuser 20.

Reference is now made to FIGS. 9 and 10 for an illustration of different lighting schemes that can be employed in accordance with the present invention. FIG. 9 shows the use of a pair of asymmetric fixtures 40, 42 arranged so that the respective lamps are directed outward and, in turn, direct the respective beams 41, 43 toward the target illumination area 44. The fixtures 40, 42 are preferably equally disposed about the center line 45 that extends to the target area 44. The asymmetric fixture array would typically be used in pairs mounted in opposing positions running lengthwise with the patient bed, dentist chair or similar application. The fixtures in FIG. 9 may, for example, be spaced 2' to 6' apart. The fixture pairs are preferably mounted centered over a bed so that the light patterns from each fixture cross several feet above the surface of the bed, thus minimizing shadows which might be caused by an individual standing on one side of the bed. Several sizes and lengths are possible to suit differing needs. For example, a dentist typically only needs illumination on the patient's head while a physician might need whole-body illumination.

FIG. 10 shows an array of symmetric fixtures 50 arranged in a side-by-side position, as well as the beams 52 from each fixture. These beams symmetrically illuminate a target illumination area 54. The symmetric distribution fixture may be mounted directly over a patient bed, dentist chair or similar application. Other reflector designs make it suitable for general illumination purposes. Multiple cells of reflectors/diffusers may be utilized to provide varying light levels. Each cell is designed to provide a narrow beam of illumination, as illustrated in FIG. 10. The beams are designed to cross above the bed or other surface in order to minimize shadows. Several sizes and lengths are possible to suit differing needs. For example, a dentist only needs illumination on the patients head while a chiropractor desires whole-body illumination.

Another lighting scheme is shown in FIG. 11 including a switch for controlling the light array. This array has two outboard asymmetric fixtures 60 and two inboard symmetric fixtures 62. These fixtures are controlled from the switch 64 which is adapted to provide electrical power to the lighting array. More particularly, control line 65 couples to only the asymmetric fixtures while line 66 couples to all fixtures. The switch 64 has two modes of operation. In a first mode only the line 65 is excited. This provides a light pattern like that shown in FIG. 9. In the second mode of the switch 64 all fixtures are excited via line 66 and the symmetric fixtures thus fill in additional light at the target area.

A further alternate embodiment of the invention is illustrated in FIG. 12. This differs from the single lamp version in that it includes two lamps 16A and 16B. In this case the diffuser 70 is of a like construction to that illustrated in FIG. 4, but has a more oval shape for the lower portion 70A. This diffuser also includes the upper refracting portion 70B and the intermediate portion 70C.

One of the features of the present invention is the ability of the diffuser to essentially hide the lamp from normal viewing angles. This is clear from, for example, FIGS. 4 and 5 wherein the very tip of the portions 20C hides the lamp from viewing. This provides diminished glare upon a patient. The diffuser portion 20A provides some level of diffused light while also, in combination with the reflector, provides reflected light to the target area. The portion 20C, while blocking direct view by the patient, provides added refracted light therethrough.

Having now described a limited number of embodiments of the present invention it should be apparent to those skilled in the art that numerous other embodiments and modifications thereof are contemplated as falling within the scope of the present invention, as defined by the appended claims.

What is claimed is:

1. A lumenaire comprising:

a lighting fixture;

a lamp supported in the lighting fixture and having a horizontal centerline, a highest point and a lowest point;

a diffuser disposed spaced from and at least partially about the lamp and including;

a middle portion under the lamp comprised of a material with a predetermined pattern for both reflecting and transmitting incident light from the lamp, and end portions contiguous with said middle portion disposed toward the sides of the lamp and comprised of a material for refracting incident light from the lamp;

wherein said middle portion comprises a translucent plastic base; and wherein said end portions are formed by respective substantially straight extensions of said translucent plastic base, both said extensions terminating at a position above a horizontal centerline of the lamp so as to obscure the image of the lamp from viewing angles therebelow;

wherein each said substantially straight extension extends along a straight line axis and terminates in a free end;

wherein the axes of said respective extensions converge;

and wherein both free ends terminate at a location below the highest point of the lamp.

2. The lumenaire of claim 1 wherein said end portions have a ribbed inwardly facing surface and a smooth outwardly facing surface.

3. The lumenaire of claim 1 wherein said middle portion comprises a semi-cylindrical portion and said free ends of the extensions define therebetween a lineal locus line that intersects the lamp above the horizontal centerline.

4. A lumenaire comprising:

a lighting fixture;

a lamp supported in the lighting fixture;

a diffuser disposed spaced from and at least partially about the lamp and including;

a middle portion under the lamp comprised of a material with a predetermined pattern for both reflecting and transmitting incident light from the lamp, and end portions contiguous with said middle portion disposed toward the sides of the lamp and comprised of a material for refracting incident light from the lamp;

wherein said middle portion is arc-shaped and includes a translucent plastic base, for supporting inside thereof, a partially reflective liner that carries said predetermined pattern;

wherein said end portions are formed by respective extensions of said translucent plastic base, said extensions terminating at a position above a horizontal centerline of the lamp so as to obscure the image of the lamp from all viewing angles therebelow.

5. The lumenaire of claim 4 wherein said liner includes in the pattern areas that are translucent to permit light to be transmitted and areas that are metallic to permit light to be reflected to a reflector disposed over the lamp.

6. The lumenaire of claim 4 including a reflector supported in the lighting fixture over the lamp with the lamp disposed asymmetrically relative to the reflector closer to one side of the fixture than another side of the fixture and with the end portions positioned to enable incident light from the lamp to be reflected from the reflector.

7. The lumenaire of claim 6 wherein said reflector comprises a straight walled section adjacent the one side of the fixture and an arcuate shaped section adjacent the another side of the fixture.

8. A lumenaire comprising:

a lighting fixture;

a lamp supported in the lighting fixture;

a diffuser disposed spaced from and at least partially about the lamp and including;

a middle portion under the lamp comprised of a material with a predetermined pattern for both reflecting and transmitting incident light from the lamp, and end portions contiguous with said middle portion disposed toward the sides of the lamp and comprised of a material for refracting incident light from the lamp;

wherein said middle portion is arc-shaped and includes a translucent plastic base, for supporting inside thereof, a partially reflective liner that carries said predetermined pattern including a liner retention tab between the middle portion and each end portion for holding the liner in place.

9. A lumenaire comprising:

a lighting fixture;

a lamp supported in the lighting fixture;

a diffuser disposed spaced from and at least partially below and at least partially about the lamp;

and a reflector supported in the lighting fixture over the lamp with the lamp disposed asymmetrically relative to the reflector closer to one side of the fixture than another side of the fixture;

said reflector being an asymmetric reflector;

said reflector including a straight walled section at the one side of the fixture and an arcuate shaped section adjacent the another side of the fixture wherein the reflector arcuate shaped section includes contiguous first and second arcuate shaped sections intercoupled by a step section.

10. The lumenaire of claim 9 wherein the diffuser includes a middle portion under the lamp comprised of a material with a predetermined pattern for both reflecting and transmitting incident light from the lamp and end portions contiguous with said middle portion disposed toward the sides of the lamp and comprised of a material for refracting incident light from the lamp.

11. The lumenaire of claim 9 wherein the end portions are positioned to enable incident light from the lamp to be reflected from the reflector.

12. The lumenaire of claim 9 wherein the diffuser includes a middle portion under the lamp comprised of a material with a predetermined pattern for both reflecting and transmitting incident light from the lamp;

wherein the middle portion is arc-shaped and carries a predetermined pattern with respective light reflecting and light transmitting areas;

wherein the light reflecting area includes an inner arc-shaped light reflective metallic surface that is reflective of impinging light;

and wherein the light transmitting area includes a light translucent surface that allows light to be transmitted through the diffuser.

13. The lumenaire of claim 12 wherein the diffuser comprises a base of a clear plastic material defining light transmitting areas, and a liner that defines the reflective surface and disposed in a predetermined reflection pattern.

14. The lumenaire of claim 12 wherein the diffuser comprises a base of a clear plastic material defining light transmitting areas, and a liner that defines the reflective surface and disposed in a predetermined reflection pattern.

15. A lumenaire comprising:

a lighting fixture;

a lamp supported in the lighting fixture;

a diffuser disposed spaced from and at least partially below and about the lamp;

and a reflector supported in the lighting fixture over the lamp with the lamp disposed asymmetrically relative to the reflector closer to one side of the fixture than another side of the fixture;

said reflector including a straight walled section adjacent the one side of the fixture and an arcuate shaped section adjacent the another side of the fixture;

wherein the reflector arcuate shaped section includes contiguous first and second arcuate shaped sections intercoupled by a step section;

wherein the first arcuate shaped section steps up from the second arcuate shaped section and the first arcuate shaped section is more remote from the one side of the fixture than the second arcuate shaped section.

16. The lumenaire of claim 15 wherein the diffuser includes a middle portion under the lamp comprised of a material with a predetermined pattern for both reflecting and transmitting incident light from the lamp;

wherein the middle portion is arc-shaped and carries a predetermined pattern with respective light reflecting and light transmitting areas;

wherein the light reflecting area includes an inner arc-shaped light reflective metallic surface that is reflective of impinging light;

and wherein the light transmitting area includes a light translucent surface that allows light to be transmitted through the diffuser.

17. The lumenaire of claim 16 wherein the diffuser comprises a base of a clear plastic material defining light transmitting areas, and a liner that defines the reflective surface and disposed in a predetermined reflection pattern.

18. A lighting apparatus that is adapted for support from a ceiling and that comprises:

a lighting housing;

a lamp supported in the lighting housing and having a horizontal centerline;

a diffuser disposed spaced from and at least partially about the lamp and including, in the middle thereof, an arc-shaped concave portion disposed under the lamp for both reflecting and transmitting incident light from the lamp and, at opposed ends thereof, end ribbed portions contiguous with said arc-shaped portion and at least one of said end ribbed portions being disposed over the horizontal centerline of the lamp for refracting incident light from the lamp;

said arc-shaped concave portion comprising a semi-cylindrical portion and said end portions having free ends extending in a relative convergence therebetween;

and a reflector supported in the lighting housing over the lamp.

19. The lighting apparatus of claim 18 wherein the reflector is an asymmetric reflector and the lamp is disposed asymmetrically relative to the reflector closer to one side of the lighting housing than another side of the lighting housing.

20. The lighting apparatus of claim 19 wherein said reflector including a straight walled section adjacent the one side of the lighting housing and an arcuate shaped section adjacent the another side of the lighting housing.

21. The lighting apparatus of claim 18 wherein the free ends of the end ribbed portions define therebetween a linear locus line that intersects the lamp above the horizontal centerline.

22. A lumenaire comprising:

a lighting fixture;

a lamp supported in the lighting fixture;

a diffuser disposed spaced from, at least partially below and at least partially about the lamp for both reflecting and transmitting incident light from the lamp;

and a reflector supported in the lighting fixture over the lamp with the lamp disposed asymmetrically relative to the reflector closer to one side of the fixture than another side of the fixture;

said reflector including at least first and second portions;

both said at least first and second portions being of arcuate shape;

wherein the diffuser includes a middle portion under the lamp comprised of a material with a predetermined pattern for both reflecting and transmitting incident light from the lamp;

wherein the middle portion is arc-shaped having an arc-shaped interior reflective surface enabling the reflecting of light and being perforated enabling the transmitting of the light through the diffuser;

wherein said diffuser further includes end portions contiguous with said middle portion disposed toward the sides of the lamp and comprised of a material for refracting incident light from the lamp;

wherein said middle portion comprises a semi-cylindrical portion and said end portions each have free ends extending in a relative convergence therebetween;

and wherein the free ends of the extensions define therebetween a linear locus line that intersects the lamp above the horizontal centerline.

23. A lumenaire comprising:

a lighting fixture;

a lamp supported in the lighting fixture;

a diffuser disposed spaced from, at least partially below and at least partially about the lamp for both reflecting and transmitting incident light from the lamp;

and a reflector supported in the lighting fixture over the lamp with the lamp disposed asymmetrically relative to the reflector closer to one side of the fixture than another side of the fixture;

said reflector including at least first and second portions;

both said at least first and second portions being of arcuate shape;

wherein the diffuser includes a middle portion under the lamp comprised of a material with a predetermined pattern for both reflecting and transmitting incident light from the lamp;

and wherein the middle portion is arc-shaped having an arc-shaped interior reflective surface enabling the reflecting of light and being perforated enabling the transmitting of the light through the diffuser;

wherein the reflector further includes a step section that provides a transition between said first and second arcuate portions.

24. A lumenaire comprising:

a lighting fixture;

a lamp supported in the lighting fixture;

a diffuser disposed spaced from, at least partially below and at least partially about the lamp for both reflecting and transmitting incident light from the lamp;

and a reflector supported in the lighting fixture over the lamp with the lamp disposed asymmetrically relative to the reflector closer to one side of the fixture than another side of the fixture;

said reflector including at least first and second sections;

both said at least first and second sections being of arcuate shape; and wherein the first and second sections have different radii of curvature;

and wherein the reflector further includes a step section that provides a transition between the first and second arcuate sections.

25. The lumenaire of claim 24 wherein the reflector further includes a straight walled section adjacent the one side of the fixture and one of said arcuate portions being disposed adjacent the another side of the fixture.

26. The lumenaire of claim 24 wherein the diffuser includes a middle portion under the lamp comprised of a material with a predetermined pattern for both reflecting and transmitting incident light from the lamp;

wherein the middle portion is arc-shaped and carries a predetermined pattern with respective light reflecting and light transmitting areas;

wherein the light reflecting area includes an inner arc-shaped light reflective metallic surface that is reflective of impinging light;

and wherein the light transmitting area includes a light translucent surface that allows light to be transmitted through the diffuser.

27. The lumenaire of claim 26 wherein the diffuser comprises a base of a clear plastic material defining light transmitting areas, and a liner that defines the reflective surface and disposed in a predetermined reflection pattern.

28. A lumenaire comprising:

a lighting fixture;

a lamp supported in the lighting fixture;

a diffuser disposed spaced from, at least partially below and at least partially about the lamp for both reflecting and transmitting incident light from the lamp;

and a reflector supported in the lighting fixture over the lamp with the lamp disposed asymmetrically relative to the reflector closer to one side of the fixture than another side of the fixture;

said reflector including at least first and second sections;

both said at least first and second sections being of arcuate shape; and wherein the first curved section steps up from the second curved section and the first curved section is more remote from the one side of the fixture than the second curved section.

29. The lumenaire of claim 28 wherein the diffuser includes a middle portion under the lamp comprised of a material with a predetermined pattern for both reflecting and transmitting incident light from the lamp;

wherein the middle portion is arc-shaped and carries a predetermined pattern with respective light reflecting and light transmitting areas;

wherein the light reflecting area includes an inner arc-shaped light reflective metallic surface that is reflective of impinging light;

and wherein the light transmitting area includes a light translucent surface that allows light to be transmitted through the diffuser.

30. A lumenaire comprising:

a lighting fixture;

a lamp supported in the lighting fixture;

a diffuser disposed spaced from and at least partially about the lamp and including;

a middle portion under the lamp comprised of a material with a predetermined pattern for both reflecting and transmitting incident light from the lamp, and end portions contiguous with said middle portion disposed toward the sides of the lamp and comprised of a material for refracting incident light from the lamp, said middle portion comprising a semi-cylindrical portion and said end portions each contiguous with sides of said middle portion and having free ends extending in a relative convergence therebetween;

and wherein the free ends of the extensions define therebetween a linear locus line that intersects the lamp above the horizontal centerline, and a reflector on the opposite side of the lamp to the diffuser.

31. The lumenaire of claim 30 wherein said end portions are formed by respective extensions terminating at a position above a line that is perpendicular to the optical line of the lamp so as to obscure the image of the lamp from substantially all viewing angles therebelow.

32. The lumenaire of claim 30 wherein the lamp is centered at the center of radius of the semi-cylindrical portion, the end portions include a ribbed surface having peaks for light diffraction, the peaks of the ribbed surface defining a linear locus, and the linear locus of respective end portions extending in relative convergence.

33. A lumenaire comprising:

a lighting fixture;

a lamp supported in the lighting fixture;

a diffuser disposed spaced from and at least partially about the lamp;

and a reflector supported in the lighting fixture over the lamp;

wherein the diffuser includes a middle portion under the lamp comprised of a material with a predetermined pattern for both reflecting and transmitting incident light from the lamp;

wherein the middle portion is arc-shaped and carries a predetermined pattern with respective light reflecting and light transmitting areas;

wherein the light reflecting area includes an inner arc-shaped light reflective metallic surface that is reflective of impinging light;

wherein the light transmitting area includes a light translucent surface that allows light to be transmitted through the diffuser;

wherein the reflector is asymmetric and includes at least first and second arc-shaped portions with the lamp under only one of said first and second arc-shaped portions;

wherein the diffuser also includes end portions contiguous with said middle portion disposed toward the sides of the lamp and, at least one of said end portions is comprised of a material for refracting incident light from the lamp;

and wherein said middle portion comprises a semi-cylindrical portion and said end portions are each contiguous with sides of said middle portion and have free ends extending in a relative convergence therebetween.

34. The lumenaire of claim 33 wherein the diffuser comprises a base of a clear plastic material defining light transmitting areas, and a liner that defines the reflective surface and disposed in a predetermined reflection pattern.

35. The lumenaire of claim 34 wherein the lamp is disposed asymmetrically relative to the reflector closer to one side of the fixture than another side of the fixture.

36. The lumenaire of claim 35 wherein the light translucent surface is defined by a plurality of perforations through the diffuser.

37. The lumenaire of claim 36 wherein the end portions are ribbed.

* * * * *